US009925803B2

(12) United States Patent
Hori et al.

(10) Patent No.: US 9,925,803 B2
(45) Date of Patent: Mar. 27, 2018

(54) PRINTING APPARATUS

(71) Applicant: SEIKO EPSON CORPORATION, Tokyo (JP)

(72) Inventors: Kazuhito Hori, Azumino (JP); Masaaki Ando, Matsumoto (JP); Toshio Kumagai, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/492,998

(22) Filed: Apr. 20, 2017

(65) Prior Publication Data

US 2017/0313100 A1 Nov. 2, 2017

(30) Foreign Application Priority Data

Apr. 27, 2016 (JP) ..... 2016-089070

(51) Int. Cl.

| | |
|---|---|
| ***B41M 7/00*** | (2006.01) |
| ***B41J 2/01*** | (2006.01) |
| ***B41J 11/00*** | (2006.01) |
| *B41J 15/04* | (2006.01) |

(52) U.S. Cl.

CPC ..... *B41J 11/002* (2013.01); *B41M 7/0081* (2013.01); *B41J 15/04* (2013.01)

(58) Field of Classification Search

CPC .... B41M 7/00; B41M 7/0081; B41J 11/0015; B41J 11/002

See application file for complete search history.

(56) References Cited

U.S. PATENT DOCUMENTS

| | | | | |
|---|---|---|---|---|
| 7,137,695 | B2 * | 11/2006 | Yokoyama | B41J 11/002 347/101 |
| 8,936,360 | B2 * | 1/2015 | Fujisawa | B41J 25/304 347/101 |
| 2008/0068431 | A1 | 3/2008 | Yokoyama | |

(Continued)

FOREIGN PATENT DOCUMENTS

| | | | |
|---|---|---|---|
| EP | 1520718 | A1 | 4/2005 |
| JP | 2014-184666 | | 10/2014 |
| JP | 2016034746 | A | 3/2016 |

OTHER PUBLICATIONS

Computer-generated translation of JP 2014-184666, published on Oct. 2014.*

(Continued)

*Primary Examiner* — Huan Tran

(74) *Attorney, Agent, or Firm* — Workman Nydegger

(57) ABSTRACT

A printing apparatus includes: an ejection head that prints an image on a recording medium supported by a support member by ejecting liquid from a nozzle formed in a portion facing the support member; and an irradiation section that includes a housing which is open toward the support member, and a light emitting section housed in the housing and emitting light to cure the liquid, the irradiation section being configured such that light emitted from the light emitting section is irradiated onto the recording medium supported by the support member via the opening, wherein the housing includes an inclined section which extends from the opening toward the ejection head such that a distance from the inclined section to the support member decreases toward the ejection head, and the inclined section is provided so that θ2>θ1 is established.

4 Claims, 4 Drawing Sheets

(56) References Cited

U.S. PATENT DOCUMENTS

| | | | | |
|---|---|---|---|---|
| 2012/0287214 | A1 | 11/2012 | Fujisawa | |
| 2014/0292968 | A1* | 10/2014 | Hayashi | B41J 11/002 347/102 |
| 2017/0217214 | A1* | 8/2017 | Sato | B41J 11/0015 |

OTHER PUBLICATIONS

European Search Report issued in Application No. 17168176 dated Sep. 20, 2017.

* cited by examiner

PRINTING APPARATUS

BACKGROUND

1. Technical Field

The present invention relates to technologies of ejecting liquid which is cured by irradiation of light from an ejection head, and printing an image by emitting light from a light irradiator.

2. Related Art

JP-A-2014-184666 describes an image recording apparatus that performs printing by using an ink which is cured by irradiation of light. This image recording apparatus ejects ink from a print head onto a recording medium supported by a support member, and then irradiates light from an irradiation section. More specifically, the print head includes a nozzle forming surface which faces the support member, and ejects ink from nozzles formed on the nozzle forming surface. Further, the irradiation section includes a housing which is open toward the support member, and irradiates light from a light source in the housing onto the recording medium via the opening.

In the aforementioned light irradiation section, after being emitted from the light source, light is reflected by the recording medium on the support member and is partially incident on the side portion of the opening (protruding section) of the housing. Here, when the light incident on the side portion of the opening of the housing is reflected toward the ejection head, the reflected light may be incident on a portion of the ejection head (print head) which faces the recording medium (nozzle forming surface). In such a case, the liquid (ink) attached on the portion of the ejection head which faces the recording medium may be cured and solidify.

SUMMARY

An advantage of some aspects of the invention is that, in a printing apparatus which ejects light-curable liquid from nozzles of an ejection head onto a recording medium on a support member and cures the liquid by light emitted from an irradiation section, a technique of reducing incidence of light on a portion of the ejection head which faces the support member is provided.

The present invention can be achieved in the following manner.

A printing apparatus according to an aspect of the present invention includes: a support member having a surface that supports a recording medium transported in a predetermined direction; an ejection head that prints an image on the recording medium supported by the support member by ejecting liquid from a nozzle formed in a portion facing the support member; and an irradiation section that includes a housing which is open toward the support member, and a light emitting section housed in the housing and emitting light to cure the liquid, the irradiation section being configured such that light emitted from the light emitting section is irradiated onto the recording medium supported by the support member via the opening, wherein the housing includes an inclined section which extends from the opening toward the ejection head such that a distance from the inclined section to the support member decreases toward the ejection head in the predetermined direction, and, in a front view in a direction perpendicular to the predetermined direction, when an acute angle between a first straight line, which is a virtual line extending along the inclined section, and a normal on a surface of the support member at an intersection between the first straight line and the surface of the support member is defined as an angle $\theta 1$, and an acute angle between a second straight line, which is a virtual line extending from an end of the facing portion of the ejection head located close (or adjacent) to the irradiation section to the intersection, and the normal is defined as an angle $\theta 2$, the inclined section is provided so that $\theta 2 > \theta 1$ is established.

In the printing apparatus having the above configuration, the housing of the irradiation section includes the opening which is open toward the support member, and light emitted from the light emitting section housed in the housing is irradiated onto the recording medium supported by the support member via the opening of the housing. Further, the housing includes the inclined section which extends from the opening toward the ejection head such that a distance from the inclined section to the support member decreases toward the ejection head. Moreover, the inclined section is disposed to satisfy the angle $\theta 2$>angle $\theta 1$, and the inclined section suppresses the reflection of light toward the ejection head. Here, the angle $\theta 1$ is an acute angle between the first straight line, which is a virtual line extending along the inclined section, and a normal on a surface of the support member at an intersection between the first straight line and the surface of the support member, while the angle $\theta 2$ is an acute angle between the second straight line, which is a virtual line extending from an end of the facing portion of the ejection head located close to the irradiation section to the intersection, and the normal. As a result, incidence of light on a portion of the ejection head which faces the support member can be suppressed.

Further, the printing apparatus may be configured such that the ejection head is provided on each of both sides of the irradiation section in the predetermined direction, and the irradiation section includes the inclined section on each of both sides of the opening in the predetermined direction. In this configuration, incidence of light on the portion of the ejection head which faces the support member disposed on both sides of the irradiation section can be suppressed.

Further, the printing apparatus may be configured such that the housing includes a protruding wall that protrudes from an end of the inclined section located opposite from the ejection head in the predetermined direction toward the support member, and the opening is defined by an end of the protruding wall located close to the support member. In this configuration, an irradiation area of the light on the recording medium is limited by the protruding wall that defines the opening. Accordingly, a light reflection area on the recording medium is limited, and thus generation of light which is reflected by the inclined section toward the ejection heads can be reduced. This is advantageous to suppress incidence of light on the portion of the ejection head which faces the support member.

Further, the printing apparatus may be configured such that a light reflection rate by the inclined section is 65% or less. In this configuration, generation of light which is reflected by the inclined section toward the ejection heads can be reduced. This is advantageous to suppress incidence of light on the portion of the ejection head which faces the support member.

It should be noted that a plurality of elements of the aspects of the present invention described above are not necessarily essential. In order to solve part or all of the above problem, or to achieve part or all of the effect described in this specification, part of the plurality of elements can be altered, eliminated, or replaced with other new elements, or the limitations on the plurality of elements can be partially deleted as appropriate. Further, in order to solve part or all of the above problem, or to achieve part or all of the effect described in this specification, part or all of the technical feature included in an embodiment of the present invention can be combined with part or all of the technical features included in another embodiment of the present invention to provide an independent embodiment of the present invention.

BRIEF DESCRIPTION OF THE DRAWINGS

Embodiments of the invention will now be described by way of example only with reference to the accompanying drawings, wherein like numbers reference like elements.

DESCRIPTION OF EXEMPLARY EMBODIMENTS

Figure 1:
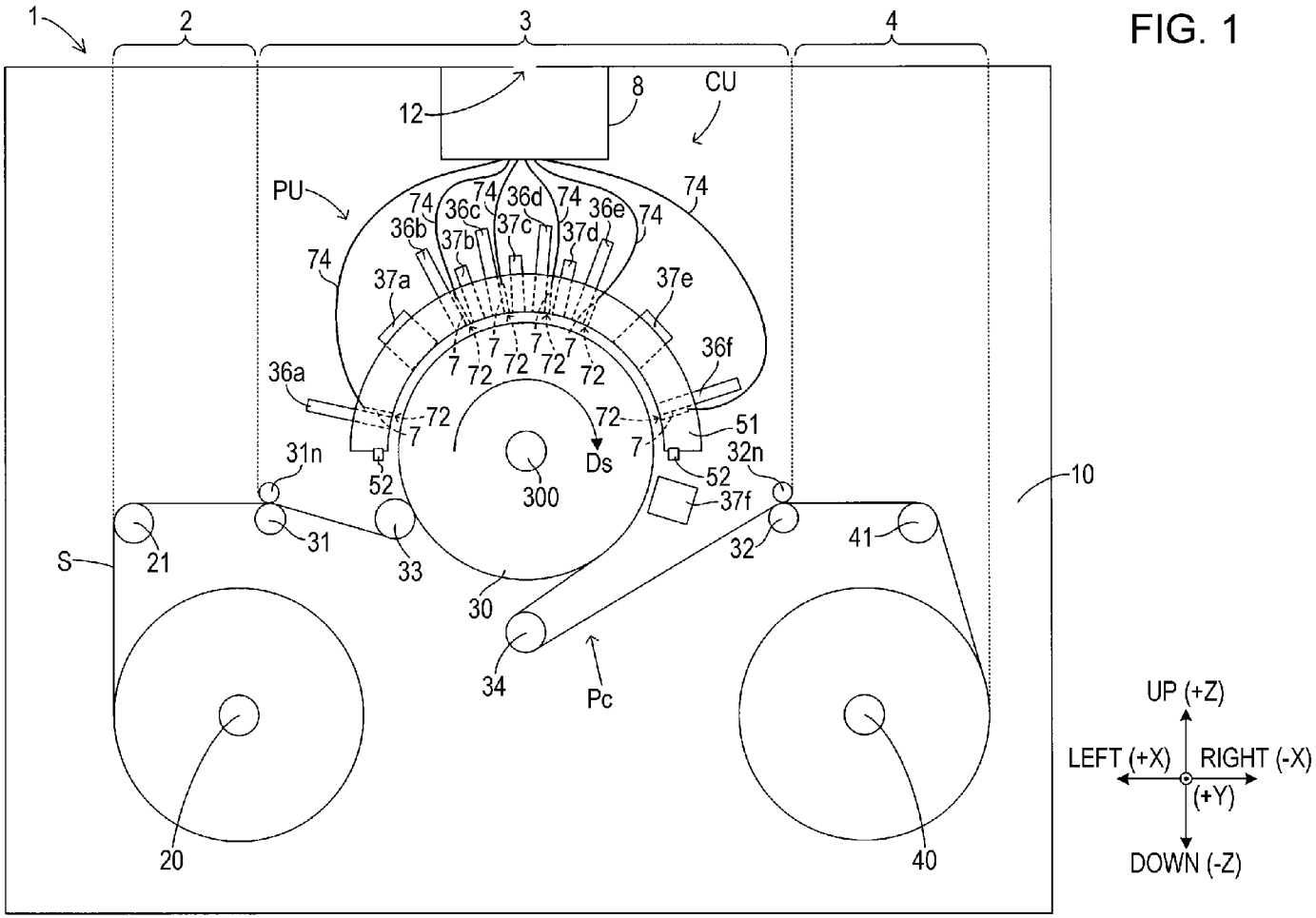
FIG. 1 is a view which shows a general configuration of a printer according to the present invention.

FIG. 1 is a front view which schematically shows a general configuration of a printer according to the present invention. In order to clarify the positional relationship of components of the apparatus in FIG. 1 and the subsequent figures, the XYZ orthogonal coordinate system, which corresponds to the right-left direction X, front-back direction Y and vertical direction Z of a printer 1, is indicated as appropriate.

As shown in FIG. 1, a sheet S (web) having opposite ends, which are wound around an unwinding shaft 20 and a take-up shaft 40 into a roll-shape, is hung along a transportation path Pc in the printer 1. The sheet S undergoes an image recording process while being transported from the unwinding shaft 20 to the take-up shaft 40 in a transport direction Ds. The sheet S is broadly divided into a paper type and a film type. For example, specific examples of paper type include high-quality paper, cast paper, art paper, coated paper and the like, while specific examples of film type include synthetic paper, PET (polyethylene terephthalate), PP (polypropylene) and the like. The printer 1 schematically includes an unwinding section 2 (unwinding area) in which the sheet S is fed out from the unwinding shaft 20, a processing section 3 (processing area) in which the sheet S which is fed out from the unwinding section 2 undergoes an image recording process, and a take-up section 4 (take-up area) in which the sheet S which undergoes the image recording process in the processing section 3 is taken up by the take-up shaft 40. These functional sections 2, 3, and 4 are housed in a housing 10 and arranged in the X direction. In the following description, one of surfaces of the sheet S on which an image is recorded is referred to as a front surface, while the other is referred to as a back surface.

The unwinding section 2 includes the unwinding shaft 20 around which one end of the sheet S is wound, and a driven roller 21 on which the sheet S pulled out from the unwinding shaft 20 is wound. The unwinding shaft 20 supports the sheet S, one end of which is wound around the unwinding shaft 20 with the front surface oriented outward. As the unwinding shaft 20 rotates clockwise in the plane of FIG. 1, the sheet S wound around the unwinding shaft 20 is fed out to the processing section 3 via the driven roller 21. The sheet S is wound around the unwinding shaft 20 by using a core (not shown in the figure) which is detachably attached to the unwinding shaft 20. Accordingly, when the sheet S of the unwinding shaft 20 is used up, a new core around which the roll-shaped sheet S is wound can be attached to the unwinding shaft 20 to replace the sheet S of the unwinding shaft 20.

In the take-up section 4, the sheet S on which a color image is formed in the processing section 3 is taken up by the take-up shaft 40. Specifically, in addition to the take-up shaft 40 around which one end of the sheet S is wound, the take-up section 4 includes a driven roller 41 on which the back surface of the sheet S is wound between the take-up shaft 40 and a rear driving roller 32 of the processing section 3. The take-up shaft 40 supports the sheet S, one end of which is wound around the take-up shaft 40 with the front surface oriented outward. That is, as the take-up shaft 40 rotates clockwise in the plane of FIG. 1, the sheet S which is transported from the rear driving roller 32 of the processing section 3 is taken up by the take-up shaft 40 via the driven roller 41. The sheet S is wound around the take-up shaft 40 by using a core (not shown in the figure) which is detachably attached to the take-up shaft 40. Accordingly, when the sheet S is taken up by the take-up shaft 40 to the full, the sheet S can be detached from the take-up shaft 40 along with the core.

In the processing section 3, while the sheet S transported from the unwinding section 2 is supported by a rotation drum 30, a processing unit PU arranged along the outer peripheral surface of the rotation drum 30 performs a printing operation as appropriate so that an image is printed on the sheet S. In this processing section 3, a front driving roller 31 and a rear driving roller 32 are disposed on each of both sides of the rotation drum 30. While being transported from the front driving roller 31 to the rear driving roller 32, the sheet S is supported by the rotation drum 30 and undergoes an image printing operation.

The front driving roller 31 has a plurality of fine projections formed by thermal spraying on the outer peripheral surface to facilitate winding of the back surface of the sheet S fed out from the unwinding section 2 on the front driving roller 31. As the front driving roller 31 rotates clockwise in the plane of FIG. 1, the sheet S which is fed out from the unwinding section 2 is transported downstream in the transport direction Ds. In addition, a nip roller 31*n* is provided corresponding to the front driving roller 31. The nip roller 31*n* is biased toward the front driving roller 31 to abut the front surface of the sheet S, thereby holding the sheet S between the nip roller 31*n* and the front driving roller 31. This ensures a friction force between the front driving roller 31 and the sheet S, which allows for reliable transportation of the sheet S by the front driving roller 31.

The rotation drum 30 has a cylindrical shape with a center axis parallel to the Y direction, and is configured such that the sheet S is wound around the outer peripheral surface. Moreover, the rotation drum 30 includes a rotation shaft 300 which extends in an axis direction along the center axis of the cylindrical shape. The rotation shaft 300 is rotatably supported by a support mechanism, which is not shown, and the rotation drum 30 rotates about the rotation shaft 300.

The above rotation drum 30 is configured such that the back surface of the sheet S, which is transported from the front driving roller 31 to the rear driving roller 32, is wound on the outer peripheral surface. The rotation drum 30 supports the back surface of the sheet S while being driven to rotate in the transport direction Ds of the sheet S by the friction force against the sheet S. In addition, the processing section 3 includes driven rollers 33 and 34 that turn around the sheet S on each of both sides of a winding section of the rotation drum 30. One of these driven rollers, the driven roller 33, serves to turn around the sheet S by winding the front surface of the sheet S between the front driving roller 31 and the rotation drum 30. On the other side, the driven roller 34 serves to turn around the sheet S by winding the front surface of the sheet S between the rotation drum 30 and the rear driving roller 32. In this way, the sheet S is turned around on both the upstream and downstream sides of the rotation drum 30 in the transport direction Ds to thereby ensure a length of the winding section of the sheet S on the rotation drum 30.

The rear driving roller 32 has a plurality of fine projections formed by thermal spraying on the outer peripheral surface to facilitate winding of the back surface of the sheet S transported from the rotation drum 30 via the driven roller 34. As the rear driving roller 32 rotates clockwise in the plane of FIG. 1, the sheet S is transported to the take-up section 4. In addition, a nip roller 32*n* is provided corresponding to the rear driving roller 32. The nip roller 32*n* is biased toward the rear driving roller 32 to abut the front surface of the sheet S, thereby holding the sheet S between the nip roller 32*n* and the rear driving roller 32. This ensures a friction force between the rear driving roller 32 and the sheet S, which allows for reliable transportation of the sheet S by the rear driving roller 32.

As described above, the sheet S transported from the front driving roller 31 to the rear driving roller 32 is supported by the outer peripheral surface of the rotation drum 30. Further, in the processing section 3, the processing unit PU is provided to print a color image onto the front surface of the sheet S supported by the rotation drum 30. The processing unit PU has a configuration in which ejection heads 36*a* to 36*f* and UV irradiators 37*a* to 37*e* are supported by a carriage 51.

Six ejection heads 36*a* to 36*f* arranged in the transport direction Ds each correspond to white, yellow, cyan, magenta, black and clear (transparent), and eject the ink of the corresponding colors through the nozzles in an ink jet method. That is, in the ejection heads 36*a* to 36*f*, a plurality of nozzles is arranged in the Y direction across the width of the sheet S so that each nozzle ejects ink in the form of droplets, that is, ink droplets.

These six ejection heads 36*a* to 36*f* are radially disposed about the rotation shaft 300 of the rotation drum 30, and arranged along the outer peripheral surface of the rotation drum 30. Each of the ejection heads 36*a* to 36*f* is positioned by the carriage 51 with respect to the rotation drum 30 so as to face the rotation drum 30 with a slight clearance (platen gap) therebetween. Accordingly, each of the ejection heads 36*a* to 36*f* faces the front surface of the sheet S wound around the rotation drum 30 with a predetermined paper gap between the ejection heads 36*a* to 36*f* and the rotation drum 30. When the paper gap is thus defined by the carriage 51, the ejection heads 36*a* to 36*f* eject ink droplets so that a color image is rendered on the front surface of the sheet S by the ink droplets attached on the front surface of the sheet S at the desired positions.

The ejection head 36*a* that ejects white ink is used in the case where an image is printed on a transparent sheet S so as to render a white background on the sheet S. Specifically, the ejection head 36*a* ejects white ink across the entire surface of a region in which the image is formed to thereby render the background. Then, the ejection heads 36*b* to 36*e* eject ink of yellow, cyan, magenta, and black to render a color image that overlays the white background. Further, the ejection head 36*f* ejects clear ink to overlay the color image so that the color image is covered by the clear ink. As a result, the color image has a glossy or matte texture.

As the ink for use in the ejection heads 36*a* to 36*f*, a UV (ultraviolet) ink (light curing ink) that is cured by irradiation of ultraviolet (light) is used. Therefore, the processing unit PU is provided with UV irradiators 37*a* to 37*e* to cure the ink and fix the ink onto the sheet S. Further, this ink curing process is made up of temporary curing and full curing. The full curing is a process in which the UV light with an irradiation intensity relatively higher than that in the temporary curing is irradiated onto the ink to thereby cure the ink to an extent that stops wet spreading of ink, while the temporary curing is a process in which the UV light with a relatively lower irradiation intensity is irradiated onto the ink to thereby cure the ink to an extent that sufficiently slows the speed of wet spreading of ink compared with the case where the UV light is not irradiated.

Specifically, the UV irradiator 37*a* for full curing is disposed between the ejection head 36*a* for white ink and the ejection head 36*b* for yellow ink. Accordingly, the white background rendered by the ejection head 36*a* is cured by being exposed to the UV light from the UV irradiator 37*a* before it is overlaid with the ink from the ejection heads 36*b* to 36*e*. The UV irradiators 37*b* to 37*d* for temporary curing are disposed between each of the ejection heads 36*b* to 36*e* for yellow, cyan, magenta, and black ink. Accordingly, the ink ejected from each of the ejection heads 36*b* to 36*d* is temporarily cured by being exposed to the UV light from each of the UV irradiators 37*b* to 37*d* before it is overlaid with the ink from the ejection heads 36*c* to 36*e* each located on the downstream side of the ejection heads 36*b* to 36*d* in the transport direction Ds. This prevents the ink ejected from each of the ejection heads 36*b* to 36*e* from being mixed with each other, thereby suppressing occurrence of mixture of colors. The UV irradiator 37*e* for full curing is disposed between the ejection head 36*e* for black ink and the ejection head 36*f* for clear ink. Accordingly, the color image rendered by the ejection heads 36*b* to 36*e* is fully cured by being exposed to the UV light from the UV irradiator 37*e* before it is overlaid with the ink from the ejection heads 36*f*.

Moreover, in the processing section 3, the UV irradiator 37*f* for full curing is provided on the downstream side of the ejection head 36*f* in the transport direction Ds. Accordingly, the clear ink ejected from the ejection head 36*f* to overlay the color image is fully cured by being exposed to the UV light from the UV irradiator 37*f*. The UV irradiator 37*f* is not mounted on the carriage 51.

In addition, there may be a case where part of the ink ejected from the ejection heads 36*a* to 36*f* is not attached to the surface of the sheet S and is suspended as a mist. Therefore, the processing section 3 includes a mist collecting unit CU that collects ink mist in order to prevent the ejection heads 36*a* to 36*f* and the UV irradiators 37*a* to 37*f* from being contaminated by the ink mist. The mist collecting unit CU includes mist suction sections 7 each disposed on the downstream side of the ejection heads 36*a* to 36*f* in the transport direction Ds. Each mist suction section 7 is mounted on the carriage 51 and has a suction port 72 which is open to the rotation drum 30. The suction port 72 extends parallel to the Y direction and has a length in the Y direction larger than the area in which a plurality of nozzles are arranged in the ejection heads 36*a* to 36*f*.

Moreover, the mist collecting unit CU includes an air-liquid separation section 8, and a flexible suction hose 74 that connects the respective mist suction sections 7 and the air-liquid separation section 8. When the air-liquid separation section 8 generates a negative pressure, an air flow is generated from the suction port 72 of the mist suction section 7 to flow via the suction hose 74 to the air-liquid separation section 8, and exits through an exhaust port 12 on the housing 10. Accordingly, the ink mist is suctioned along with the air flow from the suction port 72 to the air-liquid separation section 8.

As described above, the six ejection heads 36*a* to 36*f*, five UV irradiators 37*a* to 37*e*, and the respective mist suction sections 7 are mounted on the carriage 51 to constitute the processing unit PU. On each of both ends of the carriage 51 in the X direction (transport direction Ds), guide rails 52 are disposed to extend in the Y direction, and the carriage 51 is hung over the two rails 52 in the X direction. Accordingly, the carriage 51 is movable on the guide rails 52 in the Y direction along with the ejection heads 36*a* to 36*f*, the UV irradiators 37*a* to 37*e*, and the respective mist suction sections 7. Specifically, as described below with reference to FIG. 2, the carriage 51 is movable between a print position Ta and a maintenance position Tb arranged in the Y direction.

Figure 2:
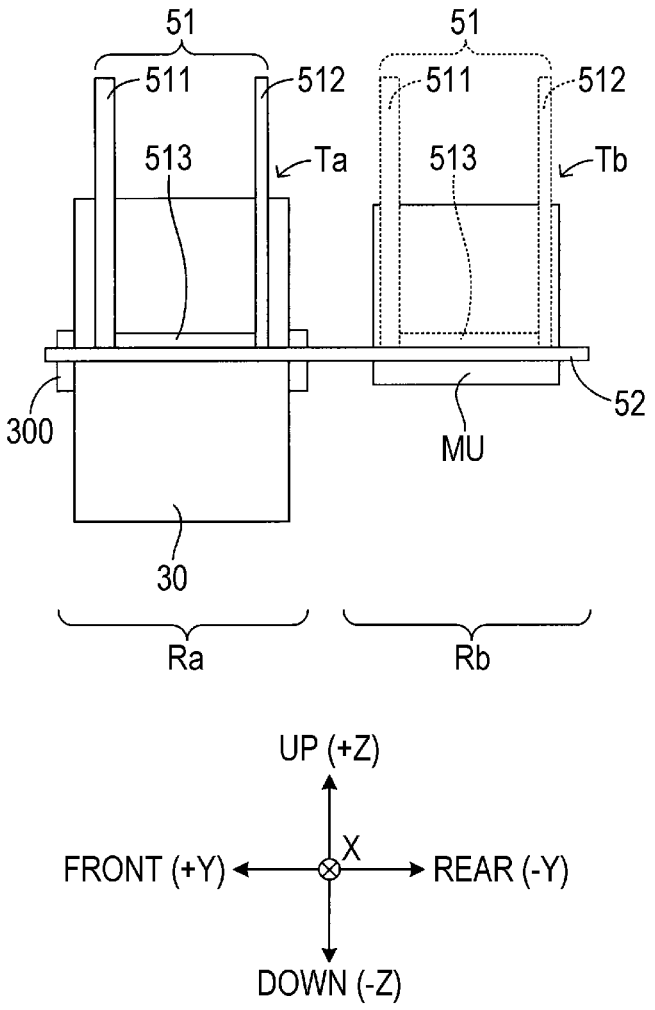
FIG. 2 is a view which shows a general configuration of the printer shown in FIG. 1.

FIG. 2 is a partial sectional view which schematically shows a general configuration of the printer shown in FIG. 1. As shown in FIG. 2, a print area Ra and a maintenance area Rb are arranged in the Y direction in the housing member 10 of the printer 1. In the print area Ra, the unwinding section 2, the processing section 3, and the take-up section 4, which are the functional sections shown in FIG. 1, are housed so as to perform printing onto the sheet S. On the other hand, at the maintenance position Tb, a maintenance unit MU performs a maintenance operation. The print position Ta and the maintenance position Tb are provided for the print area Ra and the maintenance area Rb, respectively, and the carriage 51 is configured to move between the print position Ta and the maintenance position Tb.

The carriage 51 is made up of two support frames 511 and 512 arranged in the Y direction, and a base frame 513 which connects the lower ends of the support frames 511 and 512. As seen from FIG. 1, the support frames 511 and 512 are plates having a substantially arc shape. The base frame 513, which is a plate of a rectangular shape, is provided on both ends in the X direction of each of the support frames 511 and 512 so as to connect the respective ends of the support frames 511 and 512. Then, the carriage 51 can be selectively positioned at either of the positions Ta and Tb by moving the carriage 51 along the two guide rails 52 on the right and left sides which extend across the positions Ta and Tb arranged in the Y direction.

The aforementioned ejection heads 36*a* to 36*f*, the UV irradiators 37*a* to 37*e* and the respective mist suction sections 7 are disposed between the two support frames 511 and 512 and supported by the carriage 51. In addition, in FIG. 2, these functional sections 36*a* to 36*f*, 37*a* to 37*e*, and 7 which are supported by the carriage 51 are omitted in the illustration. Further, of the print position Ta and the maintenance position Tb at which the carriage 51 is selectively positioned, the carriage 51 positioned at the print position Ta is indicated by the solid line, and the carriage 51 positioned at the maintenance position Tb is indicated by the dotted line.

When the carriage 51 is positioned at the print position Ta, the ejection heads 36*a* to 36*f*, the UV irradiators 37*a* to 37*e* and the respective mist suction sections 7 held by the carriage 51 face the rotation drum 30. Accordingly, an image can be printed on the sheet S supported by the rotation drum 30 by performing ejection of ink from the ejection heads 36*a* to 36*f* and irradiation of UV light from the UV irradiators 37*a* to 37*e*, and ink mist generated by printing operation can also be suctioned by the mist suction section 7. On the other hand, when the carriage 51 is positioned at the maintenance position Tb, the ejection heads 36*a* to 36*f*, the UV irradiators 37*a* to 37*e* and the respective mist suction sections 7 held by the carriage 51 are moved away from the rotation drum 30 in the Y direction. Accordingly, a desired maintenance can be performed while preventing interference with the sheet S supported by the rotation drum 30.

That is, the maintenance unit MU is disposed under the maintenance position Tb, and, in the state in which the carriage 51 is positioned at the maintenance position Tb, the ejection heads 36*a* to 36*f*, the UV irradiators 37*a* to 37*e* and the respective mist suction sections 7 face the maintenance unit MU. The maintenance unit MU has a semi-cylindrical shape with the circumference oriented upward, and comes close to the rotation drum 30 in the Y direction so that the arc corresponds to or is located slightly inside the rotation drum 30 as seen in the Y direction. Then, the maintenance unit MU performs various maintenance operations such as capping, cleaning, and wiping to the ejection heads 36*a* to 36*f* held by the carriage 51 which is positioned at the maintenance position Tb.

Capping is an operation by which a nozzle forming surface 361 (FIG. 3) in the ejection heads 36*a* to 36*f* to which nozzles are open is covered with a cap in the maintenance unit MU. This capping operation can prevent thickening of ink in the nozzles of the ejection heads 36*a* to 36*f*. Further, cleaning is an operation by which ink is forcibly discharged from the nozzles by the maintenance unit MU generating a negative pressure in the cap while the ejection heads 36*a* to 36*f* are capped. This cleaning operation can remove the thickened ink or air bubbles in the ink from the nozzles. Wiping is an operation by which the nozzle forming surface 361 of the ejection heads 36*a* to 36*f* is wiped by a wiper of the maintenance unit MU. This wiping operation can wipe off the ink from the nozzle forming surface 361 of the ejection heads 36*a* to 36*f*.

Figure 3:
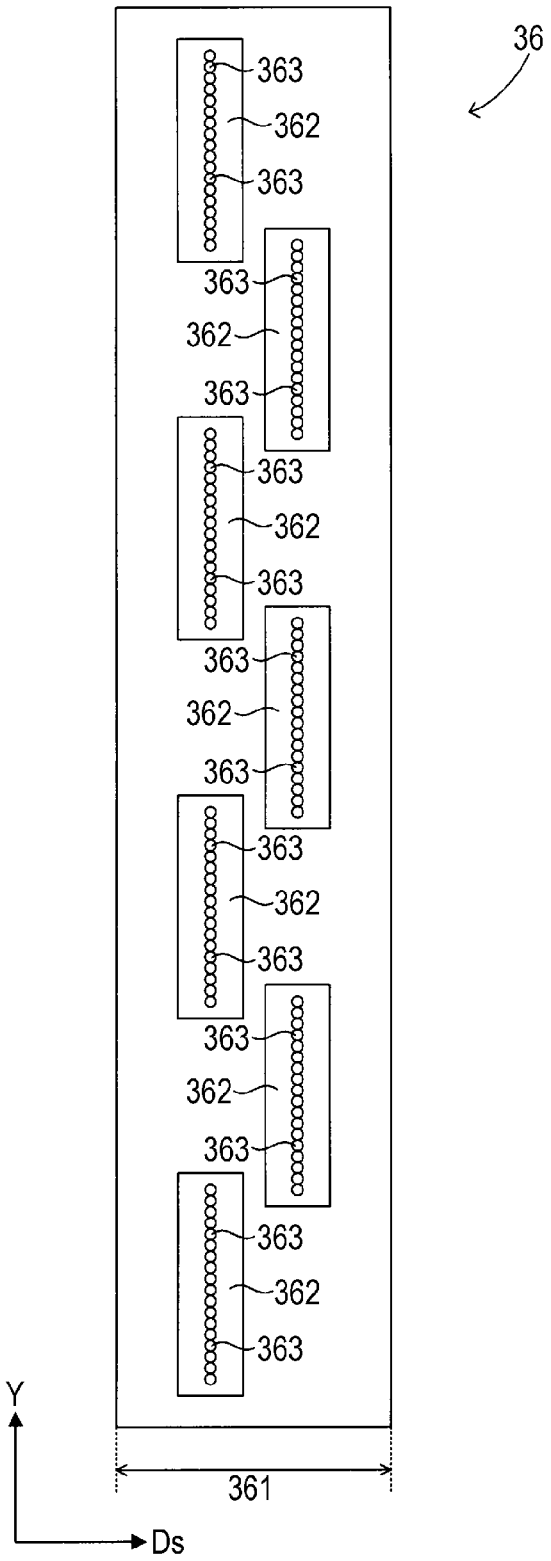
FIG. 3 is a view which shows a configuration of a nozzle forming surface of an ejection head.

FIG. 3 is a view which schematically shows a configuration of the nozzle forming surface of an ejection head 36. In the following description, the ejection heads 36*a* to 36*f* are not individually described, and are collectively referred to as the ejection head 36 as appropriate. In the ejection head 36 shown in FIG. 1, a portion which faces the rotation drum 30 serves as the nozzle forming surface 361. As shown in FIG. 3, the nozzle forming surface 361 of the ejection head 36 is formed in a substantially rectangular shape having a predetermined width in the transport direction Ds. In the nozzle forming surface 361, a plurality of unit heads 362 is arranged in a staggered pattern along two lines in the Y direction which is perpendicular to the transport direction Ds. Further, each unit head 362 includes a plurality of nozzles 363 which are arranged in the Y direction. Thus, the nozzle forming surface 361 of the ejection head 36 has a plurality of nozzles 363 arranged in the Y direction. As described above, wiping by the maintenance unit MU is an operation by which the nozzle forming surface 361 is wiped by the wiper. Accordingly, the nozzle forming surface 361 is a surface which faces the rotation drum 30 and also a surface wiped by the wiper in the wiping operation. In this embodiment, the UV irradiators 37*a* to 37*f* are configured to suppress the incidence of light on the nozzle forming surface 361 of the ejection head 36.

Figure 4:
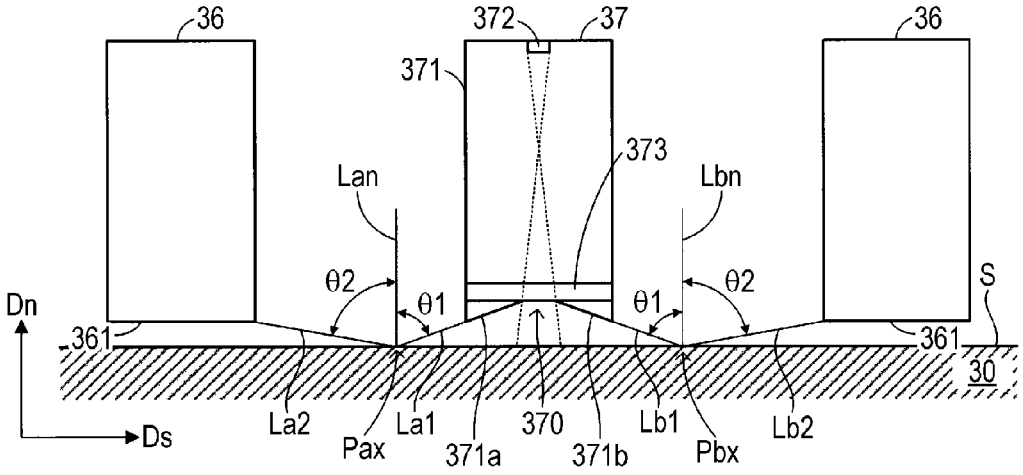
FIG. 4 is a view which shows a first configuration example of a UV irradiator.

FIG. 4 is a view which schematically shows a first configuration example of the UV irradiator. In the figure, a surface (circumferential surface) of the rotation drum is approximately illustrated by a straight line. Further, in the figure, a normal direction Dn (which is perpendicular to the transport direction Ds) on the surface of the rotation drum is indicated, and the figure shows a front view as seen in the direction perpendicular to the transport direction Ds and the normal direction Dn. In the following description, the UV irradiators 37*a* to 37*f* are not individually described, and are collectively referred to as the UV irradiator 37 as appropriate.

As shown in the figure, the UV irradiator 37 includes a housing 371 on which an opening 370 is formed to face the rotation drum 30, and a light emitting section 372 housed in the housing 371. The light emitting section 372 is oriented to the opening 370 from the opposite side of the rotation drum 30, with the sheet S interposed between the opening 370 and the rotation drum 30. The light emitting section 372 is a light emitter such as a UVLED, a metal halide lamp, and a mercury lamp. In the width direction of the sheet S (Y direction), one or more light emitters are arranged in an area larger than the width of the ejection head 36. Moreover, the housing 371 includes inclined sections 371*a* and 371*b* disposed on each of both sides of the opening 370 in the transport direction Ds. The inclined section 371*a* and the inclined section 371*b* are longer than the light emitting section 372 in the width direction of the sheet S (Y direction). In addition, the opening 370 is defined by the ends of the inclined sections 371*a* and 371*b* which are oriented to the light emitting section 372. A glass plate 373 (light transmitting member), which is disposed in the housing 371 between the light emitting section 372 and the opening 370, is supported by these inclined sections 371*a* and 371*b*. Accordingly, the light emitted from the light emitting section 372 passes through the glass plate 373, and is then irradiated onto the sheet S on the rotation drum 30 via the opening 370. Here, the light which is partially reflected by the sheet S and the rotation drum 30 is again reflected by the inclined sections 371*a* and 371*b*. To deal with this issue, the UV irradiator 37 has a configuration to prevent the light, which is again reflected by the inclined sections 371*a* and 371*b*, from being incident on the nozzle forming surface 361 of the ejection head 36.

That is, a distance from the inclined section 371*a* located upstream of the opening 370 in the transport direction Ds to the rotation drum 30 decreases toward the ejection head 36 which is adjacent to and upstream of the UV irradiator 37 in the transport direction Ds (the ejection head 36 on the left side in FIG. 4). On the other hand, a distance from the inclined section 371*b* located downstream of the opening 370 in the transport direction Ds to the rotation drum 30 decreases toward the ejection head 36 which is adjacent to and downstream of the UV irradiator 37 in the transport direction Ds (the ejection head 36 on the right side in FIG. 4). The distance from the inclined sections 371*a* and 371*b* to the rotation drum 30 can be obtained as a distance in the normal direction Dn on the surface of the rotation drum 30.

The relation between the inclined section 371*a* on the upstream side and the ejection head 36 adjacent to and upstream of the UV irradiator 37 (relation shown in the left half in FIG. 4) in the transport direction Ds will be described in detail as below. That is, when an acute angle between a first straight line La1, which is a virtual line extending along the inclined section 371*a*, and a normal Lan on the front surface of the rotation drum 30 at an intersection Pax between the first straight line La1 and the surface of the rotation drum 30 is defined as an angle θ1, and an acute angle between a second straight line La2, which is a virtual line extending from a downstream end of the nozzle forming surface 361 of the ejection head 36 in the transport direction Ds to the intersection Pax and the normal Lan is defined as an angle θ2, the inclined section 371*a* is provided so that θ2>θ1 is established.

The relation between the inclined section 371*b* on the downstream side and the ejection head 36 adjacent to and downstream of the UV irradiator 37 (relation shown in the right half in FIG. 4) in the transport direction Ds will be described in detail as below. That is, when an acute angle between a first straight line Lb1, which is a virtual line extending along the inclined section 371*b*, and a normal Lbn on the surface of the rotation drum 30 at an intersection Pbx between the first straight line Lb1 and the surface of the rotation drum 30 is defined as an angle θ1, and an acute angle between a second straight line Lb2, which is a virtual line extending from an upstream end of the nozzle forming surface 361 of the ejection head 36 in the transport direction Ds to the intersection Pbx and the normal Lbn is defined as an angle θ2, the inclined section 371*b* is provided so that θ2>θ1 is established.

The inclined sections 371*a* and 371*b* shown in FIG. 4 are included in each of the UV irradiators 37*a* to 37*e*. Further, the UV irradiator 37*f* need include only the inclined section 371*a* on the upstream side in the transport direction Ds, corresponding to the ejection head 36*f* which is adjacent to and upstream of the UV irradiator 37*f* in the transport direction Ds.

As described above, in the printer 1 of the present embodiment, the housing 371 of the UV irradiator 37 includes the opening 370 which is open toward the rotation drum 30, and light emitted from the light emitting section 372 housed in the housing 371 is irradiated onto the sheet S supported by the rotation drum 30 via the opening 370 of the housing 371. Further, the housing 371 includes the inclined sections 371*a* and 371*b* each extending from the opening 370 toward the ejection head 36 such that the distance from the inclined sections 371*a* and 371*b* to the rotation drum 30 decreases toward the ejection head 36, and light emitted from the light emitting section 372 and reflected by the sheet S is reflected by the inclined sections 371*a* and 371*b*. Moreover, as described above, the inclined sections 371*a* and 371*b* are disposed to satisfy the angle θ2>angle θ1, and the inclined sections 371*a* and 371*b* suppress the reflection of light toward the ejection head 36. As a result, incidence of light on the nozzle forming surface 361 of the ejection head 36 can be suppressed.

Further, the ejection head 36 is disposed on each of both sides of the (or at least one or some) UV irradiator 37 in the transport direction Ds, and the UV irradiator 37 includes the inclined sections 371*a* and 371*b* on both sides of the opening 370 in the transport direction Ds. In this configuration, incidence of light on the nozzle forming surface 361 of the respective ejection heads 36 disposed on both sides of the UV irradiator 37 can be suppressed.

As described above, in the present embodiment, the printer 1 corresponds to an example of the "printing apparatus" of the present invention, the rotation drum 30 corresponds to an example of the "support member" of the present invention, the transport direction Ds corresponds to an example of the "predetermined direction" of the present invention, the sheet S corresponds to an example of the "recording medium" of the present invention, the ejection heads 36, 36*a* to 36*f* correspond to an example of the "ejection head" of the present invention, the nozzle forming surface 361 corresponds to an example of the "facing portion" of the present invention, the UV irradiators 37, 37*a* to 37*e* or 37*f* correspond to an example of the "irradiation section" of the present invention, the opening 370 corresponds to an example of the "opening" of the present invention, the housing 371 corresponds to an example of the "housing" of the present invention, the light emitting section 372 corresponds to an example of the "light emitting section" of the present invention, the inclined section 371*a*, 371*b* each corresponds to an example of the "inclined section" of the present invention, the first straight line La1, Lb1 each corresponds to an example of the "first straight line" of the present invention, the intersection Pax, Pbx each corresponds to an example of the "intersection" of the present invention, normal Lan, Lbn each corresponds to an example of the "normal" of the present invention, the angle θ1 corresponds to an example of the "angle θ1" of the present invention, the second straight line La2, Lb2 each corresponds to an example of the "second straight line" of the present invention, and the angle θ2 corresponds to an example of the ""angle θ2" of the present invention.

Figure 5:
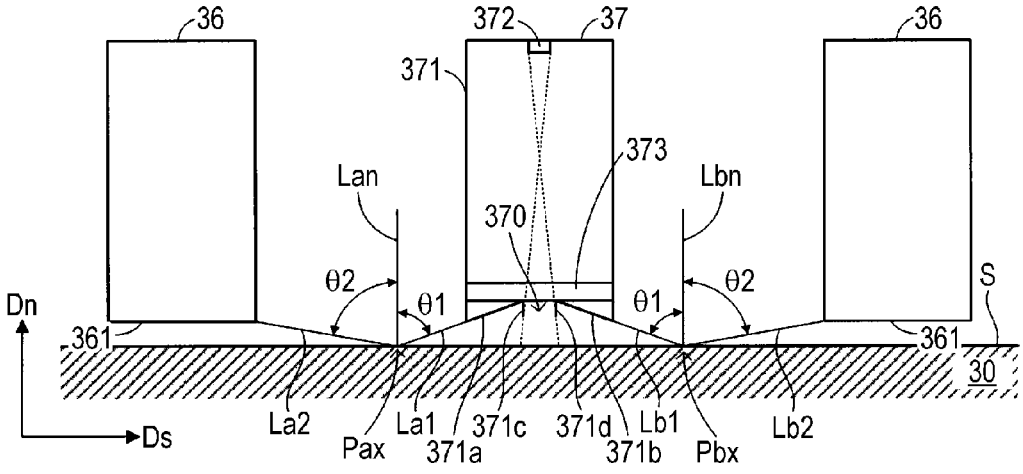
FIG. 5 is a view which shows a second configuration example of the UV irradiator.

Furthermore, the present invention is not limited to the above embodiments, and various modifications can be made to the above embodiments without departing from a scope of the present invention as defined by the appended claims. Accordingly, the UV irradiator 37 can be configured as described below. FIG. 5 is a view which schematically shows a second configuration example of the UV irradiator. References in FIG. 5 are the same as those of FIG. 4. In the following description, differences from the first configuration example shown in FIG. 4 will be focused on, and the common configurations are referred to by the corresponding reference numerals and the description thereof is omitted as appropriate. As a matter of course, in the second configuration example shown in FIG. 5, the same effect can also be obtained by virtue of having the above common configurations.

As shown in FIG. 5, the UV irradiator 37 in the second configuration example includes protruding walls 371*c* and 371*d* each protruding toward the rotation drum 30 from the ends of the inclined sections 371*a* and 371*b*, respectively, which are close to the opening 370 in the transport direction Ds, in other words, the ends of the inclined sections 371*a* and 371*b* on the side opposite from the ejection head 36. In addition, the opening 370 is defined by the ends of the protruding walls 371*c* and 371*d* on the side close to the rotation drum 30 (lower ends in FIG. 5). In this configuration, an irradiation area of the light on the sheet S is limited by the protruding walls 371*c* and 371*d*. Accordingly, a light reflection area on the sheet S is limited, and thus generation of light which is reflected by the inclined sections 371*a* and 371*b* toward the ejection heads 36 can be reduced. This is advantageous to suppress incidence of light on the nozzle forming surface 361 of the ejection head 36.

Moreover, in all embodiments the inclined sections 371*a* and 371*b* can be provided with a surface treatment or the like to adjust the reflection rate. Specifically, light reflection rate by the inclined sections 371*a* and 371*b* is preferably set to 65% or less. In this configuration, generation of light which is reflected by the inclined sections 371*a* and 371*b* toward the ejection heads 36 can be reduced. Accordingly, it is advantageous for suppression of incidence of light on the nozzle forming surface 361 of the ejection head 36.

Further, the UV irradiator 37 may be configured so that a length of the normal from the opening 370 to the light emitting section 372 (of the normal on the surface of the rotation drum 30 extending via the light emitting section 372) becomes 40% or more of the width of the opening 370 in the transport direction Ds. Accordingly, ink mist generated in the ejection head 36 can be prevented from being attached onto the glass plate 373.

Further, the above inclined sections 371*a* and 371*b* need not necessarily be provided in every UV irradiator 37 in the printer 1. That is, for the UV irradiator 37 having a distance to the adjacent ejection head 36 in the transport direction Ds which is larger than a predetermined distance, there may be a case where light emitted from the UV irradiator 37 may be regarded to be sufficiently reduced until it reaches the nozzle forming surface 361 of the ejection head 36. In such a case, the UV irradiator 37 need not necessarily include either or both the inclined sections 371*a* and 371*b*.

Further, in the above embodiment, the sheet S is supported by the cylindrical rotation drum 30. However, the member that supports the sheet S may have any shape, and, for example, the sheet S may also be supported by a surface of a plate.

This application claims priority under 35 U.S.C. §119 to Japanese Patent Application No. 2016-089070, filed Apr. 27, 2016. The entire disclosure of Japanese Patent Application No. 2016-089070 is hereby incorporated herein by reference.

What is claimed is:

1. A printing apparatus comprising:

a support member having a surface for supporting a recording medium transported in a predetermined direction;

an ejection head for printing an image on the recording medium supported by the support member by ejecting liquid from a nozzle formed in a portion facing the support member; and an irradiation section that includes a housing which is open toward the support member, and a light emitting section housed in the housing for emitting light to cure the liquid, the irradiation section being configured such that light emitted from the light emitting section can be irradiated onto the recording medium supported by the support member via the opening, wherein the housing includes an inclined section which extends from the opening toward the ejection head such that a distance from the inclined section to the support member decreases toward the ejection head in the predetermined direction or an opposite direction, and, in a front view in a direction perpendicular to the predetermined direction, when an acute angle between a first straight line, which is a virtual line extending along the inclined section, and a normal to a surface of the support member at an intersection between the first straight line and the surface of the support member is defined as an angle θ1, and an acute angle between a second straight line, which is a virtual line extending from an end of the facing portion of the ejection head located close to the irradiation section to the intersection, and the normal is defined as an angle θ2, the inclined section is provided so that θ2>θ1 is established.

2. The printing apparatus according to claim 1, wherein the ejection head is provided on each of both sides of the irradiation section in the predetermined direction, and the irradiation section includes the inclined section on each of both sides of the opening in the predetermined direction.

3. The printing apparatus according to claim 1, wherein the housing includes a protruding wall that protrudes from an end of the inclined section located opposite from the ejection head in the predetermined direction or the opposite direction toward the support member, and the opening is defined by an end of the protruding wall located close to the support member.

4. The printing apparatus according to claim 1, wherein light reflection rate of the inclined section is 65% or less.

* * * * *